US005221047A

United States Patent [19]

Akeel

[11] Patent Number: 5,221,047

[45] Date of Patent: Jun. 22, 1993

[54] METHOD AND SYSTEM FOR CLEANING A PAINT SUPPLY LINE AND CHANGING PAINT COLORS IN PRODUCTION PAINT OPERATIONS

[75] Inventor: Hadi A. Akeel, Rochester Hills, Mich.

[73] Assignee: GMFANUC Robotics Corporation, Auburn Hills, Mich.

[21] Appl. No.: 744,361

[22] Filed: Aug. 13, 1991

[51] Int. Cl.[5] ..... B05B 15/02

[52] U.S. Cl. ..... 239/123; 239/104; 134/22.11; 15/3.51

[58] Field of Search ..... 427/421; 118/302, 408; 15/3.5, 3.51; 134/22.11; 239/104, 123, 112

[56] References Cited

U.S. PATENT DOCUMENTS

| | | | |
|---|---|---|---|
| 2,874,078 | 2/1959 | Reinhart | 15/3.5 |
| 3,108,012 | 10/1963 | Curtis | 118/408 |
| 3,348,774 | 10/1967 | Wiggins | 239/70 |
| 3,562,014 | 2/1971 | Childers et al. | 134/22.11 |
| 3,631,555 | 1/1972 | Hurst | 15/3.5 |
| 4,113,890 | 9/1978 | Long | 15/3.5 |
| 4,416,703 | 11/1983 | Scott | 134/22.11 |
| 4,416,703 | 11/1983 | Scott | 134/22.11 |
| 4,592,305 | 6/1986 | Scharfenberger | 239/112 |
| 4,728,034 | 3/1988 | Matsumura et al. | 239/112 |
| 4,898,197 | 2/1990 | Barry et al. | 134/22.11 |
| 4,993,353 | 2/1991 | Ogasawara et al. | 239/112 |
| 5,103,524 | 4/1992 | Vowles | 15/3.51 |
| 5,113,895 | 5/1992 | Le Devehat | 137/883 |

FOREIGN PATENT DOCUMENTS 8500997 3/1985 World Int. Prop. O. ..... 15/3.51

*Primary Examiner*—Andres Kashnikow
*Assistant Examiner*—Christopher G. Trainor
*Attorney, Agent, or Firm*—Brooks & Kushman

[57] ABSTRACT

Method and system are provided for cleaning a paint supply line and changing paint colors by inserting and propelling a termination piston or slug having an outer diameter which forms a sliding fit within the supply line to wipe paint off the interior walls of the supply line. Preferably, the supply line is elastic and the termination piston squeegees the paint off the interior walls. In order to more fully clean the supply line prior to changing paint colors, a predetermined amount of cleaning fluid such as a solvent is injected into the supply line behind the termination piston from a common passage of a manifold. A leading piston or slug is then inserted immediately ahead of a new paint color in the supply line. The pistons may be disposable or may be reused by recirculating them by means of shuttle assemblies and a return line. The manifold is fitted with various valves to selectively supply pressurized air, solvent and two or more paint colors to the supply line. The shuttle assemblies are also fitted with valves to shuttle the pistons between the supply and return lines. A process controller controls the timing of the valves of the manifold and the shuttle assemblies. The method and system can also be used to retrofit existing color changers in an economical yet environmentally sound fashion.

30 Claims, 6 Drawing Sheets

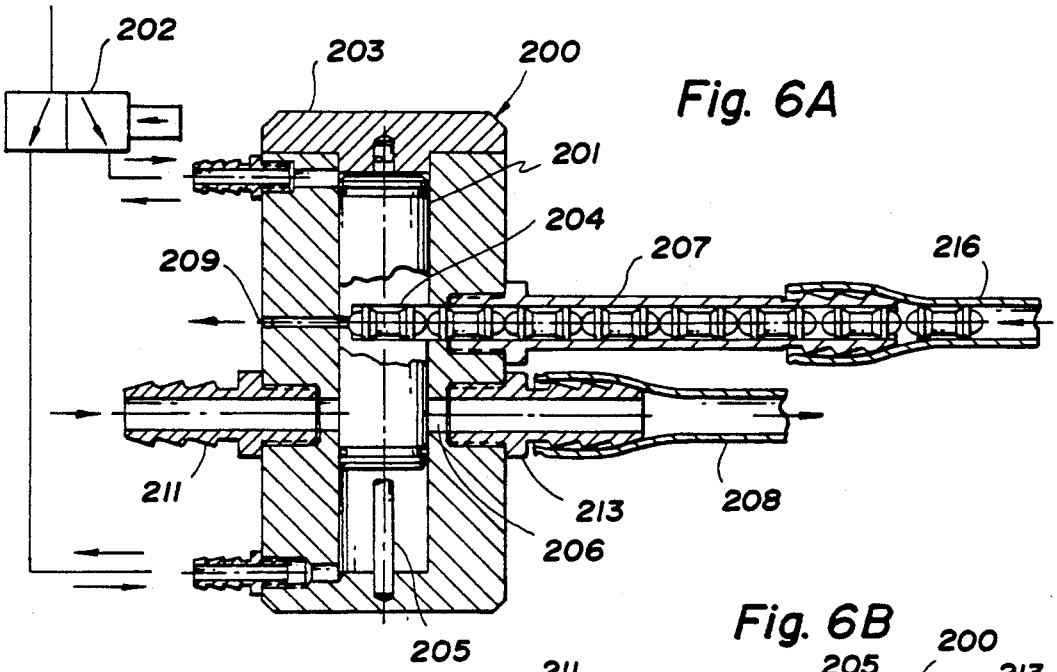
Fig. 6A
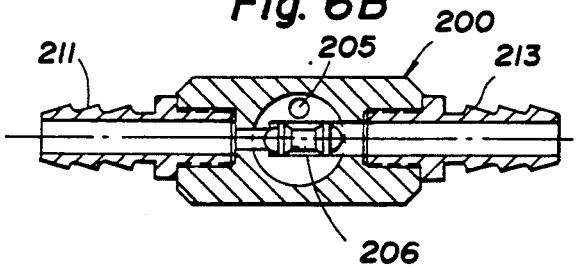
Fig. 6B
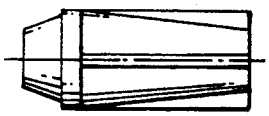
Fig. 7A
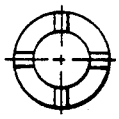
Fig. 7B
Fig. 7C
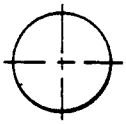
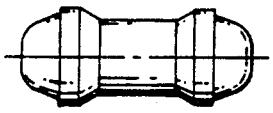
Fig. 7D
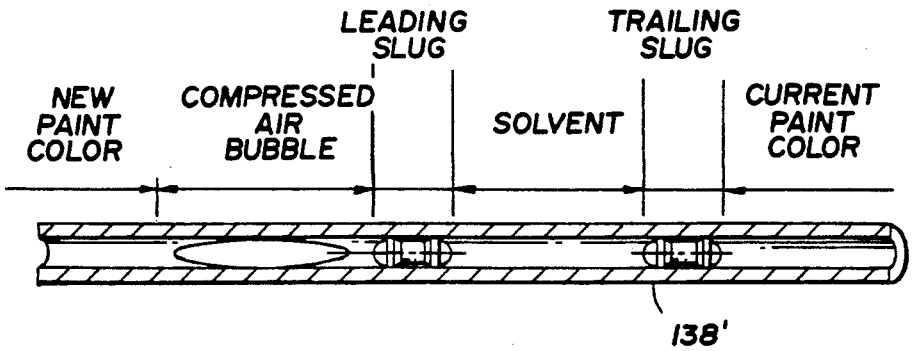
Fig. 8

METHOD AND SYSTEM FOR CLEANING A PAINT SUPPLY LINE AND CHANGING PAINT COLORS IN PRODUCTION PAINT OPERATIONS

CROSS-REFERENCE TO RELATED APPLICATION

This application is related to U.S. patent application Ser. No. 748,360 entitled "Method And System For The Productive Utilization Of Paint In A Paint Supply Line, Changing Paint Colors And Cleaning The Paint Lines In Production Paint Operations" filed on the same day as this application and having the same assignee.

TECHNICAL FIELD

This invention relates to method and system for cleaning a paint supply line and changing paint colors, and, in particular, to method and system for cleaning a paint supply line and changing paint colors in production paint operations.

BACKGROUND ART

High volume production paint operations require the changing of colors for successively painted products. For example, in an automotive production plant, car bodies are scheduled for production in an order influenced by many factors, where color is only one of such factors. As the bodies enter the paint booth, the paint equipment are set by their controllers to paint the required colors. Colors may be changed as often as for each successive car body entering the paint booth, or, the car bodies may be sequenced such that as many successive cars as possible are painted with the same color.

When colors are changed, the paint line extending from the paint color changer to the spray nozzle is thoroughly cleaned with paint solvent before the new color is introduced to fill the line to the nozzle. This is a costly and environmentally sensitive process and is highly critical that its frequency and waste be minimized.

Usually the sequence of changing colors is as follows:

1. When color change is due, the current color valve is turned OFF at an interval, Ts, before shutting off the spray. Ts is calculated to allow most of the paint remaining in the delivery line to be use productively before the line is cleaned.

2. A low pressure air, (i.e. "soft air"), valve is turned on to push the current color paint with air, having a pressure equal to the paint pressure, and use the paint in the line for productive painting. After an interval, Ts, the object of the paining is fully painted and the spray nozzle, (i.e. spray gun), is turned OFF. Some paint remains in the line and the internal line walls are usually covered with a layer of unused paint.

3. The paint delivery line is then cleaned by turning the purge cycle on. This opens an excess paint return line to a dump tank, inject solvent, or successive bursts of solvent and high pressure air, into the line and the spray nozzle, and dumps the solvent and air into the dump tank until the line is clear.

4. The line is filled with the new color paint, pushing out any excess solvent through the nozzle or to the dump tank.

Variations of this cycle exist to minimize the time required to empty and clean the line, or to minimize the wasted paint and solvent used in the process.

A typical prior art color changer is represented diagrammatically in FIG. 1.

A series of pneumatically operated two-position valves 10, 12, 14 and 16 communicate solvent source lines and paint source lines 18, 20, 22 and 24 respectively, to a common manifold, generally indicated at 26. The paint valves include return circulation lines 28, 30 and 32 which allow the paint to flow continuously back to central storage tanks regardless of paint utilization. This prevents paint pigments from settling and causing uneven paint coloring. Air lines 34 and 36 also communicate low and high pressure air, respectively, to the terminal end of the common manifold.

The manifold 26 is also communicated through the tubing of a paint delivery line 38 to a spray gun/nozzle 40. The spray gun 40 may also be fitted with a dump valve 42 and a return line 44 that allow excess paint and cleaning fluids to be returned to a dump tank 46.

Control signals, such as on lines 48, 50 and 52, allow a central programmable controller 54 to actuate any of the paint, solvent, air or spray gun actuation valves to effect the desired paint flow, paint changing, and line cleaning operations.

The method of prior art color change is represented in FIG. 2, with a flow chart. Its sequence is described by explaining the blocks of the flow chart.

At block 56, the sequence starts with a clear line. At the beginning of a shift, this is the prevailing condition as the line would have been cleaned at the end of the prior shift.

At block 58, the desired paint color valve is turned ON to pass the desired color paint in the paint delivery line 38. The dump valve 42 and/or the gun nozzle 40 is turned ON to relieve the pressure ahead of the flow of paint. The paint flows from one of the valves 12, 14 through 16 of FIG. 1 through the manifold 26 through the paint delivery line 38 to the spray gun 40 or the dump valve 42 for excess recovery. When an estimated amount of paint has flown through the desired valve, estimated by metered timing of the flow, the spray gun 40 and the dump valve 42 are turned OFF and the system is ready for productive painting with the desired color.

At block 60, with the line 38 filled, the dump valve 42 is turned OFF and the object may be sprayed by turning the gun 40 ON and OFF as necessary.

At block 62, color change is usually commanded by the programmable controller 54 of FIG. 1 ahead of the desired timing of productive painting with the current paint color. This allows the paint filling the delivery line 38 to be utilized. If color change is not due, the current paint continues to be used.

At block 64, when color change is due, the paint delivery line is cleared of the current paint. The current valve is then turned OFF to stop the flow of the current paint, and, simultaneously, a low pressure air valve 65 is turned ON for soft air push-out. Air pressure is usually the same as the paint line pressure, hence allowing continuity in the flow rate of the paint through the nozzle 40.

At block 66, when the paint object is fully painted, the flow of soft air is stopped. This is usually timed to leave some paint in the line 38 which is not utilized.

At block 68, the excess paint is recovered by turning the dump valve 42 ON and a high pressure air valve 69 ON.

At block 70, line 38 is then cleaned by sequencing the alternate opening and closing of hard air and solvent valves 69 and 70, respectively, while the dump valve 42 is ON. This sequence sends slugs of solvent through the line 38 at high speed which is effective in cleaning. After a predetermined period, determined by experiment, the line 38 is assumed clean and ready for filling by the new color.

At block 72, with the line 38 clean, the nozzle 40 is cleared by turning the gun 40 ON, and passing high pressure air, carrying solvent from the line 38 through the nozzle 40.

At block 74, if it is the end of the shift, the system is stopped with the line 38 and nozzle 40 clear and ready for the next shift, otherwise the cycle is repeated and the line 38 is filled with the new color.

Variations of this method exist. For example, U.S. Pat. No. 4,902,352 discloses a paint color change system in which the paint flow passage of the paint supply line leading to a paint atomizer is cleaned using a scrubbing medium comprising a high-pressure air containing an atomized solvent. An attempt to parallel two delivery lines so one can be cleaned while the other is being utilized for productive painting is disclosed in U.S. Pat. No. 4,487,367.

U.S. Pat. Nos. 3,108,012 to Curtis; 3,432,383 to Russell; 3,562,014 to Childers et al; 4,124,065 to Leitner et al; 4,416,703 to Scott; 4,418,747 to Baron et al; and 4,898,197 to Barry et al disclose a variety of differently configured slugs used for cleaning various types of rigid hollow tubing, pipeline and the like.

U.S. Pat. Nos. 4,508,266 to Saito et al; 4,657,047 to Kolibas; 4,700,896 to Takeuchi et al; 4,846,226 to Merritt; and 4,909,180 to Oishi et al disclose various types of color changers for paint systems generally related to the present invention.

The prior art color change methods share one or more serious shortcomings. For example, it has been shown that for the commonly used high-solids paint, almost 40% of the paint in the line adheres to the walls of the tubing and is not used for productive painting. In some applications having long paint lines, this represents a large percentage (i.e. 20%–40%) of the paint consumed in production. Much is wasted in addition to the loss of this paint. The cost of cleaning the paint with solvents, recovering the paint and the cleaning solvents for environmental protection, and in finding means for environmentally safe waste dumping for recovery is high.

Also, the time needed for cleaning the line and refilling it is a time lost of the productive time of the paint equipment and facilities. Since in a typical automotive assembly plant this time could amount to 15 seconds of each minute available for production, the paint equipment could lose as much as 25% of its productive capacity. This includes the large investment made in human resources, paint booths, robots, paint circulation and spray equipment, ovens, conveyors, etc.

Finally, the equipment used to improve the performance of color changers involves the use of a multiplicity of valves and control devices which are complex, costly, and prone to failure. Paint leaks and control failures are common occurrences in such systems.

SUMMARY OF THE INVENTION

It is an object of the present invention to provide a method and system for cleaning a paint supply line and changing paint colors in high volume production painting operations which: minimize the paint wasted with each color change; minimize the time required for changing colors; are environmentally friendly and use a minimum of solvents in cleaning the paint lines; and lend themselves for application to low cost valving, manifold and control systems.

In carrying out the above object and other objects of the present invention, a method is provided for the productive utilization of substantially all of the paint in a paint supply line, the interior walls of the supply line having substantially constant inside diameter. The method includes the steps of inserting a termination piston within the supply line, propelling the termination piston through the supply line so as to cause the termination piston to push the paint through the supply line and removing the termination piston from the supply line after the step of propelling. The termination piston is reusable and the method further includes the steps of providing a return line, inserting the removed termination piston into the return line, and propelling the termination piston through the return line. The method also includes the steps of removing the termination piston from the return line after the step of propelling the termination piston through the return line, and inserting the termination piston back into the supply line to allow the paint system to again push paint through the supply line.

Further in carrying out the above object and other objects of the present invention, a method is provided for changing paint colors using a paint system having a paint supply line, applicator means being fed with paint by the supply line and a first source of pressurized paint of a first color and a second source of pressurized paint of a second color adapted to be selectively connected to the supply line. The interior walls of the supply line have a substantially constant inside diameter. The method includes the step of connecting the supply line to the first source of pressurized paint. The method also includes the step of disconnecting the supply line from the first source of pressurized paint, and feeding the remaining paint in the supply line to the applicator means. The method includes the step of inserting a termination piston within the supply line after the step of disconnecting. The method further includes the step of propelling the termination piston through the supply line to wipe paint off the interior walls of the supply line. The method further includes the step of removing the termination piston from the supply line after the step of propelling and connecting the supply line to the second source of pressurized paint. The method further includes the steps of connecting the supply line to a source of cleaning fluid to cause cleaning fluid to enter the supply line after the step of inserting and disconnecting the supply line from the source of cleaning fluid when the amount of cleaning fluid in the supply line is sufficient to dissolve any residue paint remaining on the interior walls of the supply line after the termination piston has wiped the interior walls.

Preferably, the method also includes the step of inserting a leading piston substantially identical to said termination piston into the supply line after the step of disconnecting the supply line from the source of cleaning fluid and before the step of connecting the supply line to the second source of paint.

The method then further includes the steps of propelling the leading piston through the supply line and removing the leading piston from the supply line after the step of propelling the leading piston.

Also, preferably, both the leading and termination pistons are propelled in the supply line by the second color paint.

Also, preferably, the supply line is elastic and the termination piston squeegees the paint off the interior walls.

A system and apparatus are provided for carrying out each of the method steps.

The above object and other objects, features, and advantages of the present invention are readily apparent from the following detailed description of the best mode for carrying out the invention when taken in connection with the accompanying drawings.

BRIEF DESCRIPTION OF THE DRAWINGS

FIG. 6A is a view, partially broken away and in cross-section, of a shuttle assembly and its fluid interconnections of the present invention;

FIG. 6B is a top sectional view of the shuttle assembly and interconnections of FIG. 6A;

FIG. 7A is a side elevational view of one embodiment of a unidirectional conical slug or piston;

FIG. 7B is an end view of the slug of FIG. 7A;

FIG. 7C is an elevational view of one embodiment of a bidirectional spherical slug;

FIG. 7D is a side elevational view of another embodiment of a bidirectional cylindrical slug; and FIG. 8 is a view, partially broken away and in cross-section, illustrating the sequential flow of material in a paint supply line during a color change operation.

BEST MODE FOR CARRYING OUT THE INVENTION

Figure 1:
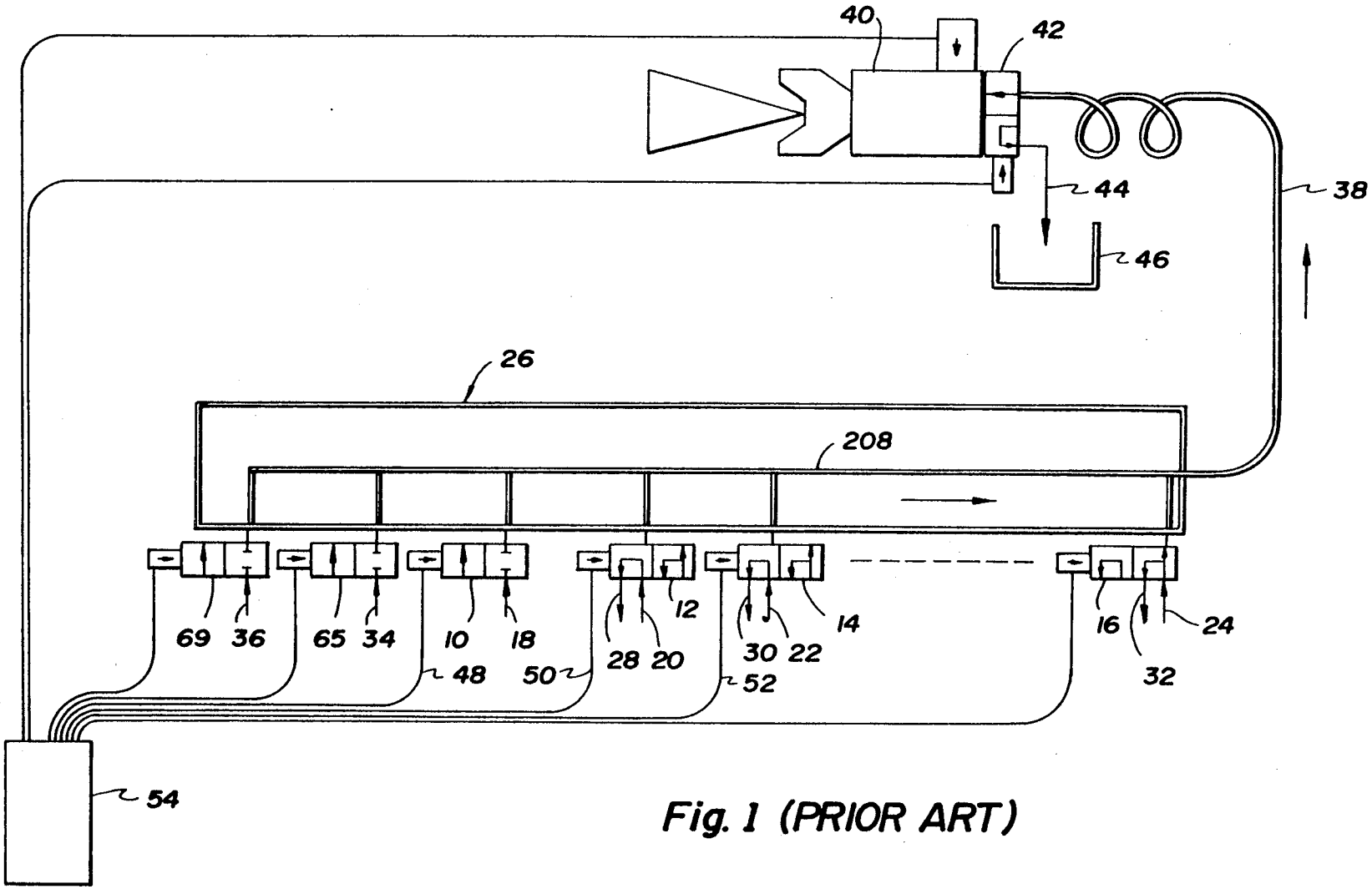
Fig. 1 (PRIOR ART)
FIG. 1 is a diagrammatical illustration of a conventional prior art color changer.

In general, the method of the present invention is a process for cleaning a paint supply line and for changing paint colors in high volume production paint operations. Specifically, the method is an approach for clearing the paint lines from one paint color to another, without waste, and for cleaning the lines with a minimum of solvent, thus improving the economics of operation and reducing hazardous waste emissions.

The method of the invention includes a number of steps. Initially, the flow of a particular paint color "the current paint" is terminated by shutting off its flow valve at a paint source manifold.

Then, a slidably fitted "termination piston or slug" is inserted into the paint line at the trailing end of the current paint column. The slug is preferably chosen to be a low friction material and is closely and slidably fitted inside the flexible paint tubing. The slug is formed to scrape or squeeze paint off the walls of the paint delivery line.

A predetermined amount of cleaning fluid such as a paint solvent then enters the supply line. Several inches of the supply line are filled with solvent behind the termination slug. The amount of solvent must be adequate to assure thorough line cleaning behind the current paint. This is determined by experiment and may vary depending on color and paint composition. This step may be done in two or more stages, with each stage of solvent flow followed by a separation slug.

The above steps of the method are initiated substantially simultaneously.

The solvent flow is terminated with the insertion of a "leading slug" into the paint line ahead of the new paint color "the new paint." The new paint flows through the line by turning on its source valve at the paint source manifold, immediately following the immediately preceding step of inserting the leading slug.

In retrofit applications of existing color changers, this step may be preceded by the use of a small amount of pressurized air to push the leading slug beyond the inlet point of the new color valve, before the trailing paint is turned on.

The slugs are then circulated through the system such that the slugs are returned back to the proximity of the paint source manifold once the flow of the paint in the line pushes them to the proximity of the spray nozzle.

Disposable slugs may be used where the slugs are put into the paint line from one end and disposed of at the other, thus avoiding the need for a slug return line at the expense of handling and dispensing the slugs.

A process controller is utilized for the timing of air, solvent, and paint color flow and shut-off, and slug insertion and circulation.

The timing of the operations are adjusted so that paint flow interruptions are minimized and kept within the dynamic time constant of the paint lines to assure that paint flow through the nozzle is not perturbed by interruptions at the paint source manifold. The controller may also monitor and control the paint flow pressure and rate and other process parameters usually associated with consistent and quality painting.

The process of the invention may be enhanced by utilizing one or more of the following steps: returning excess paint to a recovery tank; spraying part of the solvent through the nozzle to clean it, and returning the rest through a return line for recovery and safe disposal; and using several slugs in the circulating system to reduce their rate of wear and frequency of replacement for ease of maintenance.

The method can be applied to retrofit existing color changers with the addition of special designed devices and a change of the operational sequence of the valves.

Figure 3:
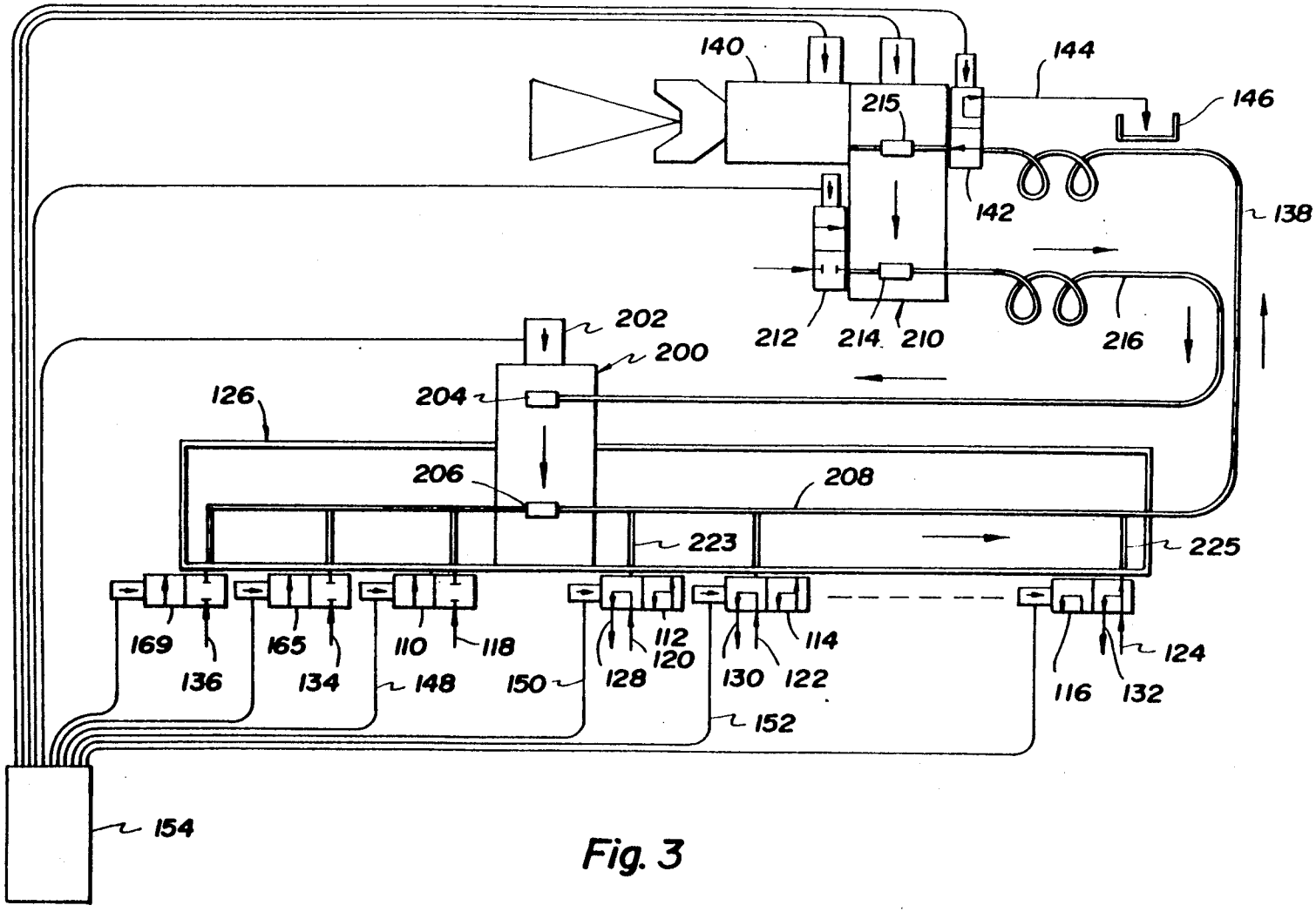
FIG. 3 is a diagrammatical illustration of the apparatus and system of the present invention.
Figure 4:
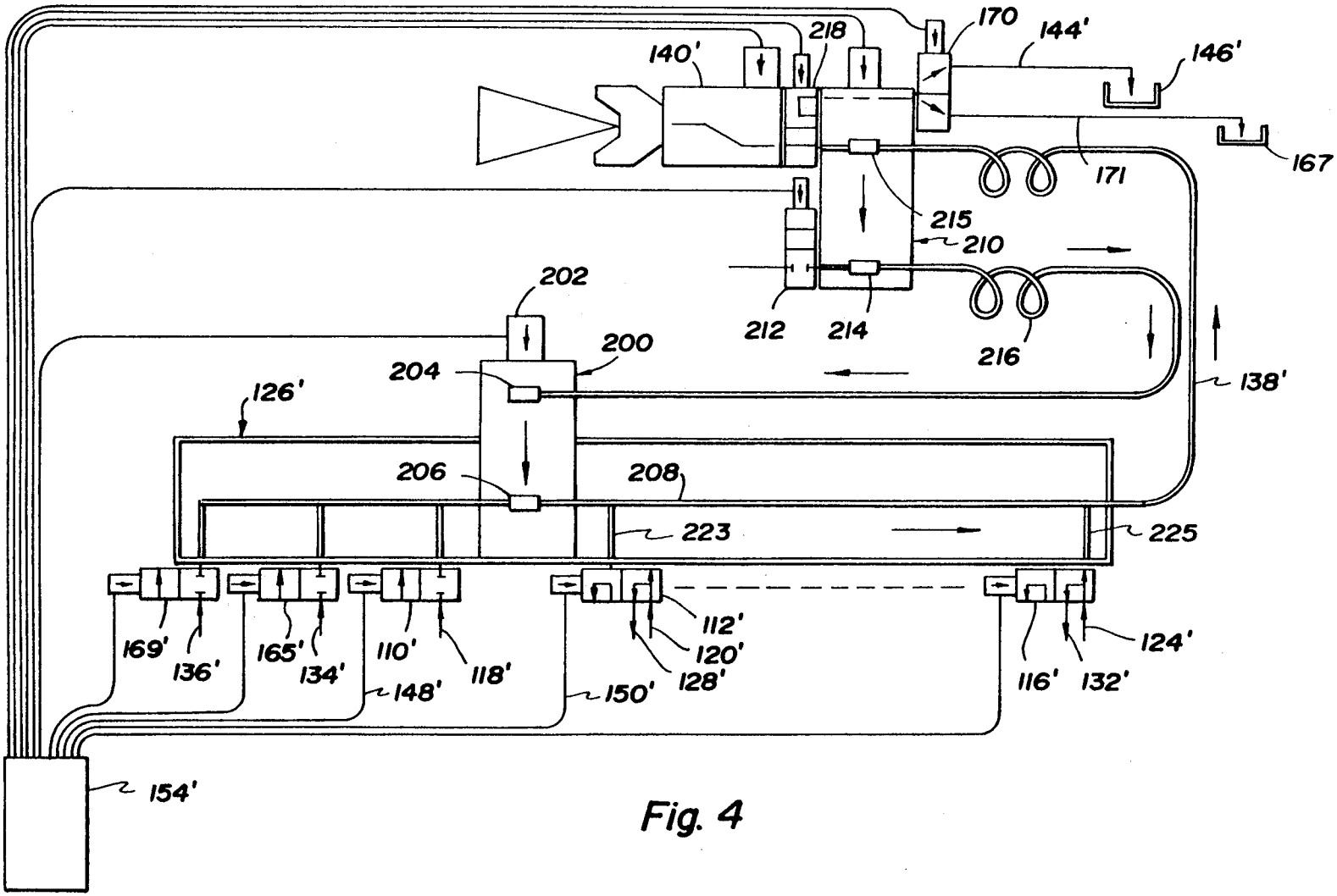
FIG. 4 is similar to FIG. 3 and illustrates another embodiment of the present invention.

Referring now to FIGS. 3 and 4, the apparatus and system of the invention is specifically shown. The parts illustrated in FIGS. 3 and 4, which are the same or similar to the parts of FIG. 1, have "100" added to their numerical designations. The parts of FIG. 4, which are the same or similar to the parts of FIG. 3, have a prime designation. FIG. 4 is now described.

A manifold 126' is fitted with paint color change valves 112' and 116', a solvent ON/OFF valve 110', a low pressure air valve 165' and a high pressure air valve 169'. Inserted between one terminal paint valve 112' and the solvent valve 110' is a slug shuttle assembly or device, generally indicated at 200. The slug shuttle assembly 200 has a two position actuator 202 which shuttles a slug from a position 204 to a position 206 in the shuttle assembly 200.

When at position 206, the slug is inserted in a common passage 208 in the manifold 126' through which all fluids, paint, solvent and air, flow to the spray nozzle 140' by means of a paint delivery or supply line or tube 138'. The paint tube 138' attaches to another shuttle assembly or device generally indicated at 210 in close proximity, and preferably integral to the spray gun 140'.

The shuttle device 210 is fitted with an ON/OFF air valve 212 which introduces pressurized air to push a slug at position 214 into a slug return line 216 back to the shuttle.

A dump valve is attached to either the shuttle assembly 210 as illustrated at 142 in FIG. 3 or the spray gun 140', as illustrated at 218 in FIG. 4. All valve actuators are operated through communication lines by a common programmable controller 154'.

The construction of the shuttle assembly 200 is shown in FIGS. 6A and 6B. The construction of the shuttle assembly 210 is similar.

The shuttle assembly 200 includes a piston/slug shuttle 201 slidably mounted within a shuttle housing 203 by a piston guide pin 205 to reciprocate so that a slug carried by the shuttle 201 can move from the position 204 (as illustrated in FIG. 6A) to the position 206 under control of the two-way valve or actuator 202.

The slugs are returned to and are stored in a return and storage line 207. A vent 209 is provided in the housing 203 to permit the compressed air propelling the slugs as well as the air pushed by the plug to exit the assembly 200.

In the position 206, as illustrated in FIG. 6B, a slug in the shuttle 201 is aligned with a solvent and air supply line 211 and a slug injection line 213 to insert the aligned slug into the common passage 208 in the manifold 126.

METHOD OF OPERATION

Figure 2:
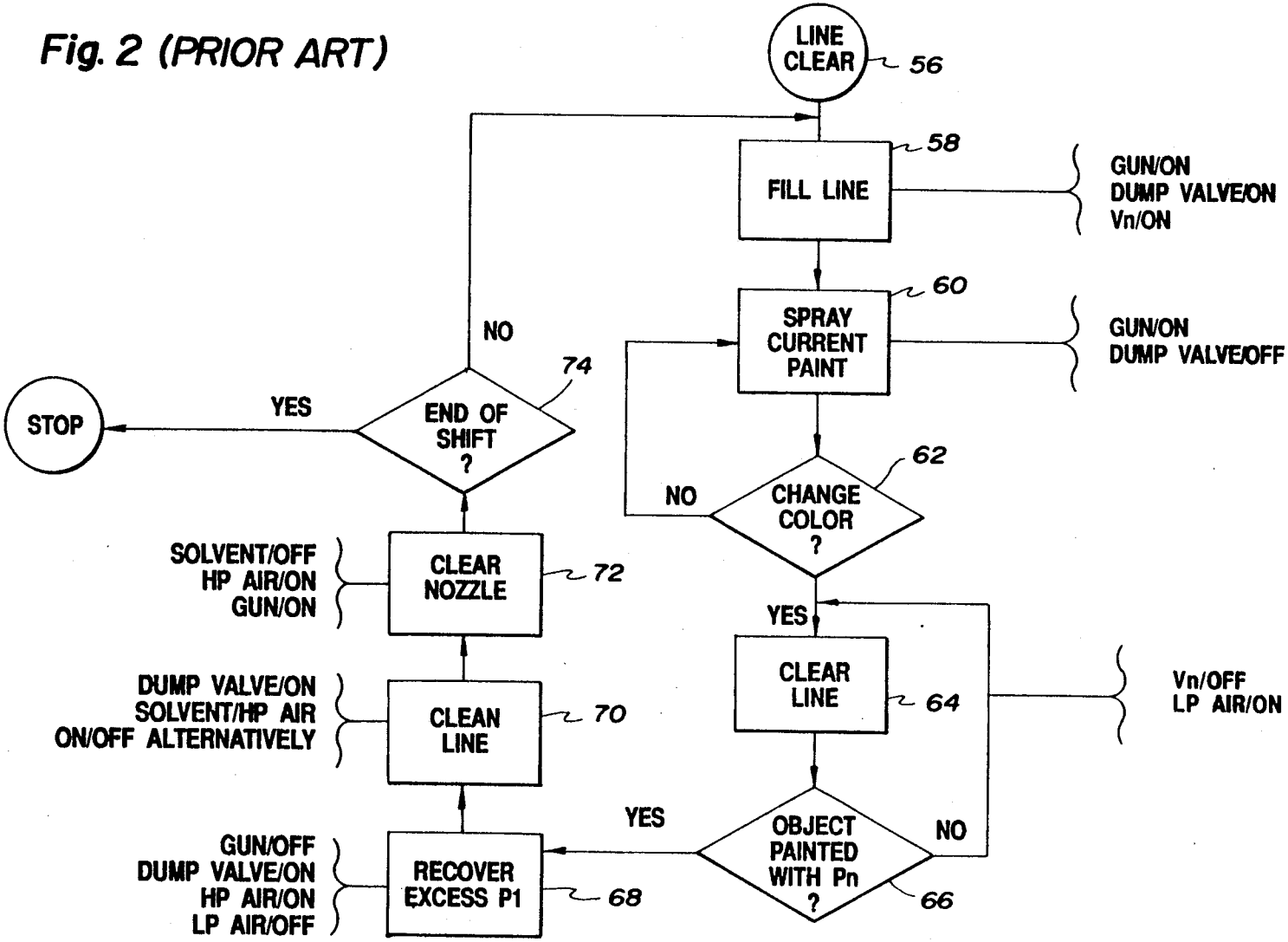
Fig. 2 (PRIOR ART)
FIG. 2 is a flow chart block diagram illustrating the method steps performed by the color changer of FIG. 1.
Figure 5:
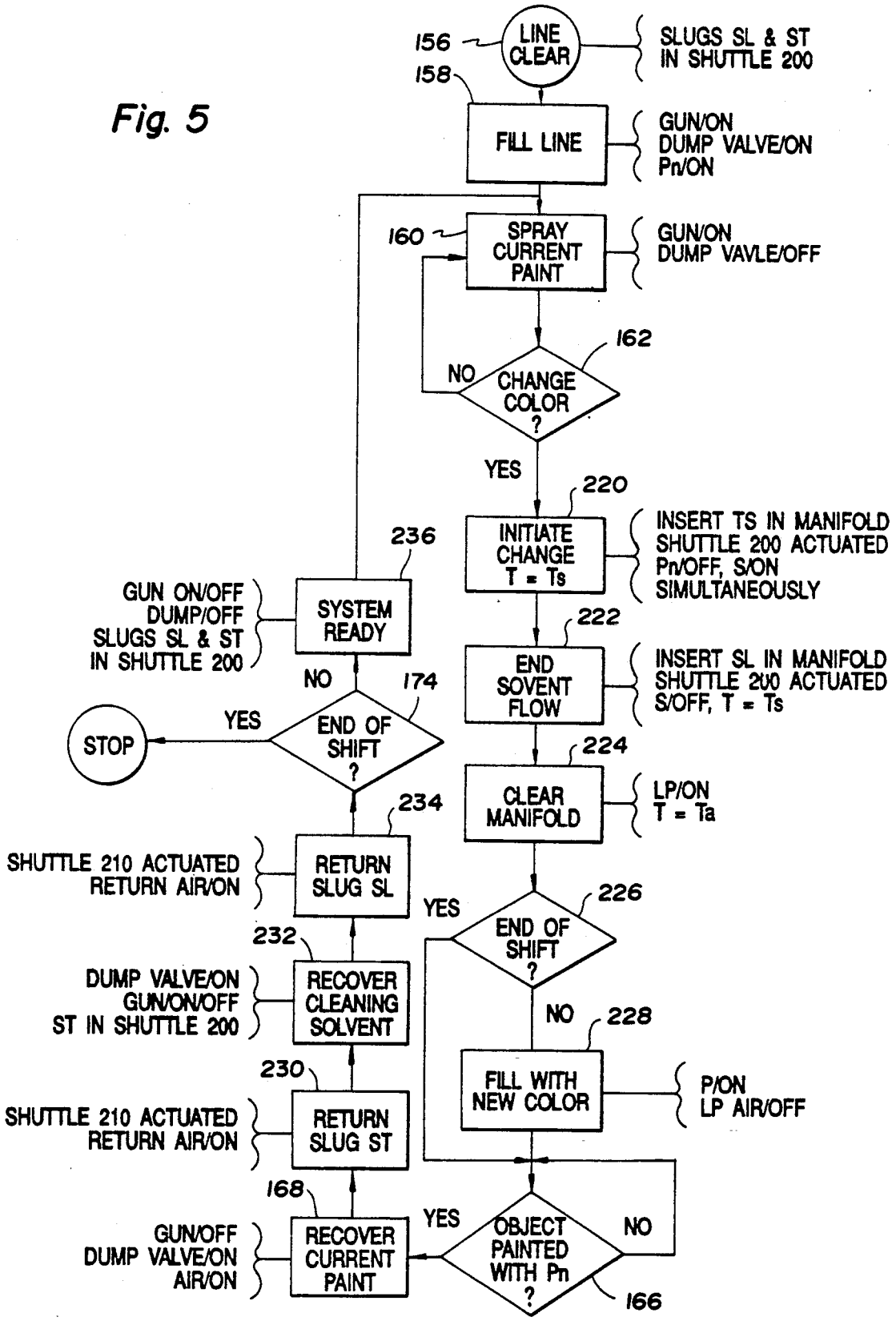
FIG. 5 is a block diagram illustrating the method steps performed by the apparatus and systems of FIGS. 3 and 4.

The method of operation according to the invention is described with reference to the event blocks of the flow chart of FIG. 5 and with reference to FIG. 4. Blocks in FIG. 5 similar to the blocks of FIG. 2 have the number "100" added to their numerical designation.

At block 156, at the start of an operation, the paint delivery line 138' is usually clear and ready to deliver paint. The leading and trailing slugs, SL and ST, respectively, are in positions 204 and 206, respectively, in the shuttle assembly 200.

At block 158, starting with a clear paint delivery line 138', the valve 112' or the valve 116' or any valve in between of the desired paint color is turned ON [Pn/ON] to allow the paint to flow through the manifold passage 208 and fill the paint delivery line 138' to the nozzle 140' and the dump valve 218. Either one or both of gun 140' and the dump valve 218 may be turned ON [dump valve/ON], [gun/ON] to allow air to escape ahead of the paint that flows into the supply line 138'.

After a time, (i.e. interval premeasured to match the completion of the filling of the supply line 138' under known paint line pressure), the gun 140' or the dump valve 218 is turned OFF. The paint is then ready at the gun 140' for productive spraying. The paint is prevented by the slug from flowing past the shuttle assembly 200. Alternatively, a valve may be used instead of the slug.

At block 160, assuming that the object of painting is in position and ready for painting and the dump valve 218 is OFF, the gun 140' is turned ON [gun/ON] to allow the paint to flow from the opened source valve 112' or valve 116' through the spray nozzle 140'.

At block 162, the programmable controller 154' is usually programmed to monitor the need for a color change according to production schedules of the paint operation. When needed, the controller 154' initiates a color change, otherwise current paint continues to be sprayed on successive objects.

At block 220, to initiate a color change, the controller 154' sends simultaneous signals to the open valve 112' or the valve 116' to close [Pn/OFF], to the solvent valve 110' to open [S/ON], and to the shuttle assembly 200 to insert a slug, ST, propelled by the solvent into the manifold passage 208 [SHUTTLE 200 ACTUATED]. The controller 154' times the flow of solvent through the manifold passage 208 for a time interval, Ts. Ts is predetermined as sufficient to introduce the correct amount of solvent into the supply line 138', accounting for paint flow rates, that is adequate to clean the supply line 138' from any traces of paint left behind the slugs.

At block 222, at the end of time interval, Ts [T=Ts], the controller 154' sends simultaneous signals to the solvent valve 110' to close [S/OFF] and to the shuttle device 200 to insert a leading slug, SL, into the manifold passage 208 [SHUTTLE ACTUATED]. SL is provided to lead the flow of paint.

At block 224, immediately following the insertion of slug, SL, into the manifold passage 208, pressurized air valve 165' or valve 169' is turned on [AIR/ON] thus allowing air to push the slug and solvent out of the manifold 126'. This operation is timed to end after a time interval, Ta [T=Ta], which is predetermined adequate to move the slug past a new color valve inlet 223 or 225 into the manifold 126' at the prevailing paint flow rate.

For systems set to a common paint pressure for all colors, the valve 165' is used and set to supply air (i.e. soft air) at the common paint pressure so as not to disturb the flow of the current paint. For systems having a common paint pressure regulator located at the spray gun, high pressure air from the valve 169' may be used and the valve 165' is eliminated.

At block 226, before introducing the new paint into the paint delivery line 138', the controller 154' checks if the terminated paint operation is the last in the shift. The line 138' is not filled with paint if the time corresponds to the end of a shift. The pressurized air continues to push the current paint, the solvent and the two slugs through the paint delivery line 138' until the object is fully painted with the current paint.

At block 228, if it is not an end of shift, the controller 154' turns air valve 165' or 169' OFF [AIR/OFF] and simultaneously turns the valve 112' or valve 116' of the desired new paint ON [P/ON]. The new paint then fills the empty manifold 126' and continues to push the current paint, the solvent, and the slugs ST and SL through paint delivery line 138' until the object is fully painted with the current paint.

The simultaneous closing of one valve 112' or the valve 116' and the opening of another, conveying a fluid of substantially the same pressure as the one closed, allows for smooth continuous flow of paint through the spray gun 146'. The capacitance of the line 138' is usually substantial enough to attenuate any time delays that may exist between signals meant to operate simultaneously.

At block 166, the controller 154' checks for completion of object painting, while the new paint continues to displace the current paint. When completed, the controller 154' initiates the recovery of the excess paint and solvent.

At block 168, with the gun 140 OFF, the dump valve 218 ON and the air valve 165' or valve 169' ON [AIR-/ON], the remaining portion of the current paint flows into a recovery tank 146' via a dump line 144'.

When fully pushed out, the trailing slug, originally at 218, now reaches a position 215 in the shuttle assembly 210. Paint of different colors mixed in the recovery tank 146' can still be utilized for ground coat painting in many applications.

A valve 170 may be utilized to direct the flow to the desired collection tank, e.g., the tank 146' for paint or a tank 167 for solvent.

At block 230, with the shuttle assembly 210 actuated, the trailing slug moves from the position 215 to the position 214 and is readied for return to the shuttle assembly 200. The air return valve 212 is then turned ON [RETURN AIR/ON]when the trailing slug is in the position 214 thus forcing it to move towards the shuttle assembly 200. The shuttle assembly 200 is then ready to insert a slug into the manifold passage 208.

At block 232, with the trailing slug, ST, removed from the shuttle assembly 210, [ST IN SHUTTLE 200], the cleaning solvent is passed for an instant through the spray nozzle 146' to clean it [GUN/ON/OFF]. The solvent then flows through the dump valve 218 [DUMP VALVE/ON], and the dump line 171 when the two-way valve 170 is activated to direct the flow to the solvent recovery tank 167. In the absence of the valve 170 unused paint and solvent may be mixed in one tank.

At block 234, when all the cleaning solvent has flown through the dump valve 218, the leading slug, SL, reaches the shuttle assembly 210. The shuttle assembly 210 is then actuated [SHUTTLE 210 ACTUATED] by the controller 154' to move the slug from position 215 to position 214 and is readied for return to the shuttle assembly 210. The air valve 212 is then actuated [RETURN AIR/ON] to effect this return.

At block 174, if at the end of the shift, the controller 154' stops the operation with the apparatus ready for a new shift with the line 138' empty, per the step of block 226, and the two slugs ST and SL are in the shuttle assembly 200, per the steps of blocks 230 and 234, and as required for block 156.

If it is not the end of a shift, the new paint would have followed the leading slug to the ports of the spray gun 140'.

At block 236, when the new paint has reached the spray gun 140', the dump valve 218 is turned OFF [DUMP/OFF]. The slugs, ST and SL, are in the shuttle assembly 200 ready for a new cycle. The gun 140' may be turned ON or OFF after flowing a spurt of the new paint. The system is then ready for a new cycle when a new object is positioned for painting.

Although shuttles 200 and 210 are described as providing linear movement for a slug from one paint line to another, 216 to 208 and 138' to 216, respectively, it should be obvious that a rotary motion, as found in a revolver gun barrel, would perform the same function. Other embodiments are also possible where the shuttle piston, being it linear or rotary, may have multiple cavities and indexed between two or more paint lines, hence allowing the use and storage of several slugs within the same color change system.

While the best mode for carrying out the invention has been described in detail, those familiar with the art to which this invention relates will recognize various alternative designs and embodiments for practicing the invention as defined by the following claims.

What is claimed is:

1. In a method for the productive utilization of substantially all paint in a paint supply line, interior walls of the supply line having substantially constant inside diameter, the method including the steps of inserting a termination piston within the supply line, propelling the termination piston through the supply line so as to cause the termination piston to push the paint through the supply line, and removing the termination piston from the supply line after the step of propelling, the improvement comprising:

the termination piston is reusable and wherein the method further includes the steps of:

providing a piston return line;

inserting the removed termination piston into the piston return line;

propelling the termination piston through the piston return line;

removing the termination piston from the piston return line after the step of propelling the termination piston through the piston return line; and inserting the termination piston back into the supply line to allow the termination piston to again push the paint through the supply line.

2. In a method for changing paint colors using a paint system having a paint supply line, applicator means being fed with paint by the supply line and a first source of pressurized paint of a first color and a second source of pressurized paint of a second color adapted to be selectively connected to the supply line, interior walls of the supply line having a substantially constant inside diameter, the method including the steps of connecting the supply line to the first source of pressurized paint, disconnecting the supply line from the first source of pressurized paint, feeding the paint in the supply line to the applicator means, inserting a termination piston within the supply line after the step of disconnecting, propelling the termination piston through the supply line so as to cause the termination piston to wipe paint off the interior walls of the supply line, removing the termination piston from the supply line after the step of propelling, and connecting the supply line to the second source of pressurized paint, the improvement comprising the additional steps of:

connecting the supply line to a source of cleaning fluid to cause cleaning fluid to enter the supply line after the step of inserting;

disconnecting the supply line from the source of cleaning fluid when the amount of cleaning fluid in the supply line is sufficient to dissolve any residue paint remaining on the interior walls of the supply line after the termination piston has wiped the interior walls; and inserting a leading piston substantially identical to said termination piston into the supply line after the step of disconnecting the supply line from the source of cleaning fluid and before the step of connecting the supply line to the second source of paint.

3. The method of claim 2 wherein the cleaning fluid includes a solvent.

4. The method of claim 2 further comprising the steps of connecting the supply line to a source of compressed gas to cause compressed gas to enter the supply line after the step of inserting the leading piston and disconnecting the supply line from the source of compressed gas when the amount of compressed gas in the supply line is sufficient to propel the leading piston a predetermined amount.

5. The method of claim 2 further comprising the steps of propelling at least a portion of the cleaning fluid in the supply line through the applicator means.

6. The method of claim 5 further comprising the step of depositing the remainder of cleaning fluid in the supply line into a sump.

7. The method of claim 2 wherein the applicator means includes a paint atomizer.

8. The method of claim 2 further comprising the steps of:

propelling the leading piston through the supply line; and removing the leading piston from the supply line after the step of propelling the leading piston.

9. The method of claim 8 wherein the termination and leading pistons are reusable and wherein the method further comprises the steps of:

providing a return line;

inserting the removed termination and leading pistons into the return line;

propelling the termination and leading pistons through the return line;

removing the termination and leading pistons from the return line after the step of propelling the termination and leading pistons through the return line; and inserting the termination and leading pistons back into the supply line to allow the paint system to again change paint colors.

10. The method of claim 8 wherein the leading piston is propelled by the second color paint.

11. The method of claim 8 further comprising the step of depositing at least a portion of the cleaning fluid into a sump by virtue of the leading piston being propelled through the supply line.

12. A paint color change system for supplying paint to an applicator means, the system comprising individual pressurized sources for at least first and second color paints, manifold means having a common passage for connecting said individual pressurized paint sources to a paint supply line adapted to feed the paint to said applicator means, interior walls of the supply line having a substantially constant inside diameter, valve means for selectively coupling said individual paint sources to said manifold, and a controller connected to said valve means and controlling operation thereof, the improvement comprising:

a termination piston having an exterior surface with an outside diameter which forms a sliding fit within the supply line;

means for inserting the termination piston within the supply line;

means for removing the termination piston from the supply line wherein the controller is also connected to said means for inserting and to said means for removing and controls operation thereof so that after one of said sources of two paints is connected to said applicator means, the termination piston is inserted into the common passage and said supply line followed by the connection of the supply line to the second source of paint so as to fill the supply line with the second color paint to allow said applicator means to again paint an article, the second color paint propelling the termination piston through the supply line so as to cause the surface of the termination piston to wipe the first color paint off the interior walls of the supply line; and an individual source of pressurized cleaning fluid, the common passage of the mainfold means connecting the source of pressurized cleaning fluid to the supply line and the valve means selectively coupling the source of pressurized cleaning fluid to said manifold, the controller controlling the valve means to introduce an amount of cleaning fluid into the common passage and the supply line sufficient to dissolve any residue of said first color paint remaining on the interior walls of the supply line after the termination piston has squeegeed the interior walls.

13. The system of claim 12 wherein the supply line is elastic relative to the surface of the termination piston and wherein the termination piston squeegees the first color paint off the interior walls of the supply line by virtue of the elasticity of the supply line.

14. The system of claim 12 further comprising means for depositing at least a portion of the removed paint into a paint sump by virtue of the termination piston being propelled through the supply line.

15. The system of claim 12 wherein the surface of the termination piston is made from a low friction material.

16. The system of claim 12 wherein the cleaning fluid includes a solvent.

17. The system of claim 16 further comprising a leading piston substantially identical to said termination piston, the controller controlling the means for inserting so that after the amount of cleaning fluid is introduced, the leading piston is inserted into the common passage before the supply line is connected to the second source of paint.

18. The system of claim 17 further comprising an individual source of compressed gas, the common passage of the manifold means connecting the source of compressed gas to the supply line and the valve means selectively coupling the source of compressed gas to said manifold, the controller controlling the valve means to introduce an amount of compressed gas into the common passage sufficient to propel the leading piston a predetermined amount within the common passage.

19. The system of claim 12 wherein said valve means selectively couples said supply line to a sump, the controller controlling the operation thereof to deposit the cleaning fluid in the supply line into the sump.

20. The system of claim 12 wherein the applicator means includes a paint atomizer.

21. The system of claim 17 wherein the leading piston is propelled through the supply line by the second color paint and wherein the controller controls the means for removing so that after the leading piston is propelled through the supply line the means for removing removes the leading piston from the supply line.

22. The system of claim 21 wherein the means for inserting is a first shuttle assembly, the means for removing is a second shuttle assembly and the termination and leading pistons are reusable and wherein the system further comprises:

a return line adapted to feed the termination and leading pistons from the second shuttle assembly to the first shuttle assembly;

means for propelling the termination and leading pistons through the return line; and the controller connected to the first and second shuttle assemblies and the means for propelling the pistons through the return line and controlling the operation thereof so that:

the second shuttle assembly removes the termination and leading pistons from the supply line and inserts the termination and leading pistons into the return line;

and the first shuttle assembly removes the termination and leading pistons from the return line after the termination and leading pistons are propelled through the return line; and inserts the termination and leading pistons into the common passage to allow the paint system to again change paint colors.

23. The system of claim 21 wherein the valve means selectively couples said supply line to a sump, the controller controlling the operation thereof to deposit at least a portion of the cleaning fluid into the sump by virtue of the leading piston being propelled through the supply line.

24. A paint color change system for supplying paint to an applicator means, the system comprising individual pressurized sources for at least first and second color paints, manifold means having a common passage for connecting said individual pressurized paint sources to a paint supply line adapted to feed the paint to said applicator means, interior walls of the supply line having a substantially constant inside diameter, valve means for selectively coupling said individual paint sources to said manifold, and a controller connected to said valve means and controlling operation thereof, the improvement comprising:

a termination piston having an exterior surface with an outside diameter which forms a sliding fit within the supply line;

means for inserting the termination piston within the supply line;

means for removing the termination piston from the supply line wherein the controller is also connected to said means for inserting and to said means for removing and controls operation thereof so that after one of said sources of two paints is connected to said applicator means, the termination piston is inserted into the common passage and said supply line followed by the connection of the supply line to the second source of paint so as to fill the supply line with the second color paint to allow said applicator means to again paint an article, the second color paint propelling the termination piston through the supply line so as to cause the surface of the termination piston to wipe the first color paint off the interior walls of the supply line wherein the means for inserting is a first shuttle assembly, the means for removing is a second shuttle assembly and the termination piston is reusable and wherein the system further comprises:

a return line adapted to feed the termination piston from the second shuttle assembly to the first shuttle assembly;

means for propelling the termination piston through the return line; and the controller being connected to the first and second shuttle assemblies and the means for propelling the termination piston through the return line and controlling the operation thereof so that: the second shuttle assembly removes the termination piston from the supply line and inserts the termination piston into the return line; and the first shuttle assembly removes the termination piston from the return line after the termination piston is propelled through the return line and inserts the termination piston back into the supply line to allow the termination piston to again wipe the paint off the interior walls of the supply line.

25. The system of claim 24 wherein at least one of the shuttle assemblies includes a double acting piston having an internal cavity and adapted to be actuated by pressurized fluid to index between first and second position thus connecting its internal cavity to the supply line in the first position and to the return line in the second position thus affecting the transfer of the piston from one line to the other line.

26. The system of claim 24 wherein at least one of the shuttle assemblies includes a rotary barrel having multiple cavities and indexed to stop at successive angular locations to position each cavity successively opposite to the supply line then to the return line thus affecting the transfer of the piston from one line to the other line.

27. The system of claim 24 wherein at least one of the shuttle assemblies includes a linearly moving piston having an internal cavity.

28. The system of claim 24 wherein at least one of the shuttle assemblies has multiple cavities.

29. The system of claim 24 wherein at least one of the shuttle assemblies includes a rotary barrel having multiple cavities.

30. A method for changing paint colors, cleaning and productively utilizing paint in a paint supply line of a high volume production paint system, the system having applicator means being fed with the paint by the supply line and a first source of pressurized paint of a first color, a source of pressurized cleaning fluid adapted to be selectively connected to the supply line and a second source of pressurized paint of a second color adapted to be selectively connected to the supply line, interior walls of the supply line having a substantially constant inside diameter, the method comprising the steps of:

connecting the supply line to the first source of pressurized paint to fill the supply line with the first color paint to allow the applicator means to paint an article;

feeding the paint in the supply line to the applicator means;

disconnecting the supply line from the first source of pressurized paint when the remaining paint in the supply line is sufficient to complete the painting of the article;

inserting a first termination piston having an exterior surface with an outside diameter which forms a close sliding fit within the supply line after the step of disconnecting;

connecting the supply line to the source of cleaning fluid, thus propelling the first termination piston through the supply line by means of the cleaning fluid so as to cause the termination piston to wipe paint off the interior walls of the supply line by virtue of the termination piston being propelled through the supply line and so as to cause the cleaning fluid to clean the interior walls of the supply line;

inserting a second termination piston after a predetermined amount of cleaning fluid has entered the supply line;

propelling the second termination piston through the supply line until essentially no paint of the first color remains in the supply line;

connecting the supply line to the second source of paint so as to fill the supply line with the second color paint to allow said applicator means to again paint an article with the second paint color; and removing the first and second termination pistons from the supply line.

* * * * *